US011674717B2

(12) United States Patent
Chaudhry et al.

(10) Patent No.: US 11,674,717 B2
(45) Date of Patent: Jun. 13, 2023

(54) WATER HEATER OPERATION MONITORING AND NOTIFICATION

(71) Applicant: Rheem Manufacturing Company, Atlanta, GA (US)

(72) Inventors: Raheel A. Chaudhry, Montgomery, AL (US); Michael C. Mitchell, Auburn, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/662,119

(22) Filed: May 5, 2022

(65) Prior Publication Data

US 2022/0260281 A1 Aug. 18, 2022

Related U.S. Application Data

(62) Division of application No. 16/775,500, filed on Jan. 29, 2020, now abandoned, and a division of (Continued)

(51) Int. Cl.
*F24H 9/45* (2022.01)
*F24H 9/20* (2022.01)

(52) U.S. Cl.
CPC ..... *F24H 9/2035* (2013.01); *F24H 9/45* (2022.01); *F23N 2227/02* (2020.01)

(58) Field of Classification Search
CPC ..... F24H 9/2035
See application file for complete search history.

(56) References Cited

U.S. PATENT DOCUMENTS 3,037,920 A 6/1962 Vixler
4,306,189 A 12/1981 Nozaki
(Continued)

FOREIGN PATENT DOCUMENTS

JP 62252823 A * 11/1987
JP 08261450 A * 10/1996
(Continued)

OTHER PUBLICATIONS

JP08261450A—machine translation (Year: 1996).*
JP2000266412A—machine translation (Year: 2000).*
JP62252823A—machine translation (Year: 1987).*

*Primary Examiner* — Nathaniel Herzfeld
(74) *Attorney, Agent, or Firm* — Eversheds Sutherland (US) LLP

(57) ABSTRACT

A water heater monitoring and notification method includes determining, by a controller of a water heater system, a deviation of a duration of a pre-purge operation from a pre-purge duration average value. The method further includes determining, by the controller of the water heater system, a deviation of a flame current from a flame current average value and determining, by the controller of the water heater system, a deviation of a pulse-width-modulation (PWM) parameter from a PWM parameter average value. The method also includes providing a notification related to a combustion system of the water heater system based on at least the deviation of the duration of the pre-purge operation from the pre-purge duration average value, the deviation of the flame current from the flame current average value, and the deviation of the PWM parameter from the PWM parameter average value.

10 Claims, 9 Drawing Sheets

Related U.S. Application Data application No. 15/851,293, filed on Dec. 21, 2017, now Pat. No. 10,571,153.

(56) References Cited

U.S. PATENT DOCUMENTS

| | | | | |
|---|---|---|---|---|
| 4,773,977 | A | 9/1988 | Houle et al. | |
| 5,439,374 | A * | 8/1995 | Jamieson | F23N 5/123 431/26 |
| 6,728,600 | B1 * | 4/2004 | Contaldo | F23N 5/203 700/20 |
| 6,932,891 | B2 | 8/2005 | Wigg et al. | |
| 2008/0302784 | A1 | 12/2008 | Knoeppel et al. | |
| 2009/0056644 | A1 | 3/2009 | Phillips et al. | |
| 2009/0308332 | A1 | 12/2009 | Fanbour | |
| 2012/0115093 | A1 * | 5/2012 | Yamashita | F23N 1/022 431/12 |
| 2014/0216945 | A1 | 8/2014 | Farris et al. | |
| 2014/0262822 | A1 | 9/2014 | Knoeppel et al. | |
| 2014/0326340 | A1 | 11/2014 | Kuriki et al. | |
| 2015/0122668 | A1 | 5/2015 | Karabin | |
| 2015/0348393 | A1 * | 12/2015 | Margolin | G08B 17/125 340/577 |
| 2016/0047547 | A1 * | 2/2016 | Barels | F23N 1/002 431/12 |
| 2017/0193794 | A1 | 7/2017 | Farris et al. | |
| 2018/0128514 | A1 | 5/2018 | Knoeppel et al. | |
| 2019/0285315 | A1 | 9/2019 | Chaudhry | |

FOREIGN PATENT DOCUMENTS

| | | | | |
|---|---|---|---|---|
| JP | 2000266412 | A * | 9/2000 | |
| WO | WO-2013032324 | A1 * | 3/2013 | F23N 1/002 |

* cited by examiner

WATER HEATER OPERATION MONITORING AND NOTIFICATION

CROSS-REFERENCE TO RELATED APPLICATIONS

This application is a divisional application of U.S. application Ser. No. 16/775,500 filed on 29 Jan. 2020, which is a divisional application of U.S. application Ser. No. 15/851,293 filed on 21 Dec. 2017, the disclosures of which are herein incorporated by reference in their entirety.

TECHNICAL FIELD

The present disclosure relates generally to water heaters, and more particularly to notifications related to operations of water heaters.

BACKGROUND

Some water heater components may degrade over time, for example, from exposure to water, heat, etc. The degradation of some water heater components may result in inefficient operation of a water heater. In some cases, the degradation of some other water heater components may eventually lead to a failure of a water heater. For example, the efficiency of a blower of a water heater may degrade over time from basic wear and tear. As another example, the storage tank of a water heater may degrade over time and start leaking water, which can eventually cause damage to structures, such as a ceiling, flooring, etc. A consumer who is aware of inefficient operations and/or deterioration of a water heater or water heater components may be able to replace defective components, resulting in improved efficiency and a prolonged life of the water heater. However, in general, detecting inefficient or defective operations of a water heater may be challenging until a significant degradation or total failure has occurred. Thus, a solution that determines the state of a water heater and/or water heater components and that provides related notifications may be desirable.

SUMMARY

The present disclosure relates generally to water heaters, and more particularly to notifications related to operations of water heaters. In some example embodiments, a water heater monitoring and notification method includes determining, by a controller of a water heater system, a deviation of a duration of a pre-purge operation from a pre-purge duration average value. The method further includes determining, by the controller of the water heater system, a deviation of a flame current from a flame current average value and determining, by the controller of the water heater system, a deviation of a pulse-width-modulation (PWM) parameter from a PWM parameter average value. The method also includes providing a notification related to a combustion system of the water heater system based on at least the deviation of the duration of the pre-purge operation from the pre-purge duration average value, the deviation of the flame current from the flame current average value, and the deviation of the PWM parameter from the PWM parameter average value.

In some example embodiments, a water heater monitoring and notification method includes detecting, by a controller of a water heater system, an anode current of one or more anode rods of a water heater system. The method further includes comparing, by the controller, the anode current to a maximum protection current of the one or more anode rods. The method also includes providing, by the controller, a first notification in response to determining that the anode current equals approximately the maximum protection current of the one or more anode rods.

In some example embodiments, a water heater monitoring and notification method includes determining a minimum flame current from among multiple flame currents and determining a maximum flame current from among the multiple flame currents. The method further includes determining whether a subsequent flame current generated at approximately the maximum gas input rate meets an operational requirement, where the subsequent flame current meets the operational requirement if the subsequent flame current is more than the minimum flame current, less than the maximum flame current, and more than a threshold flame current.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
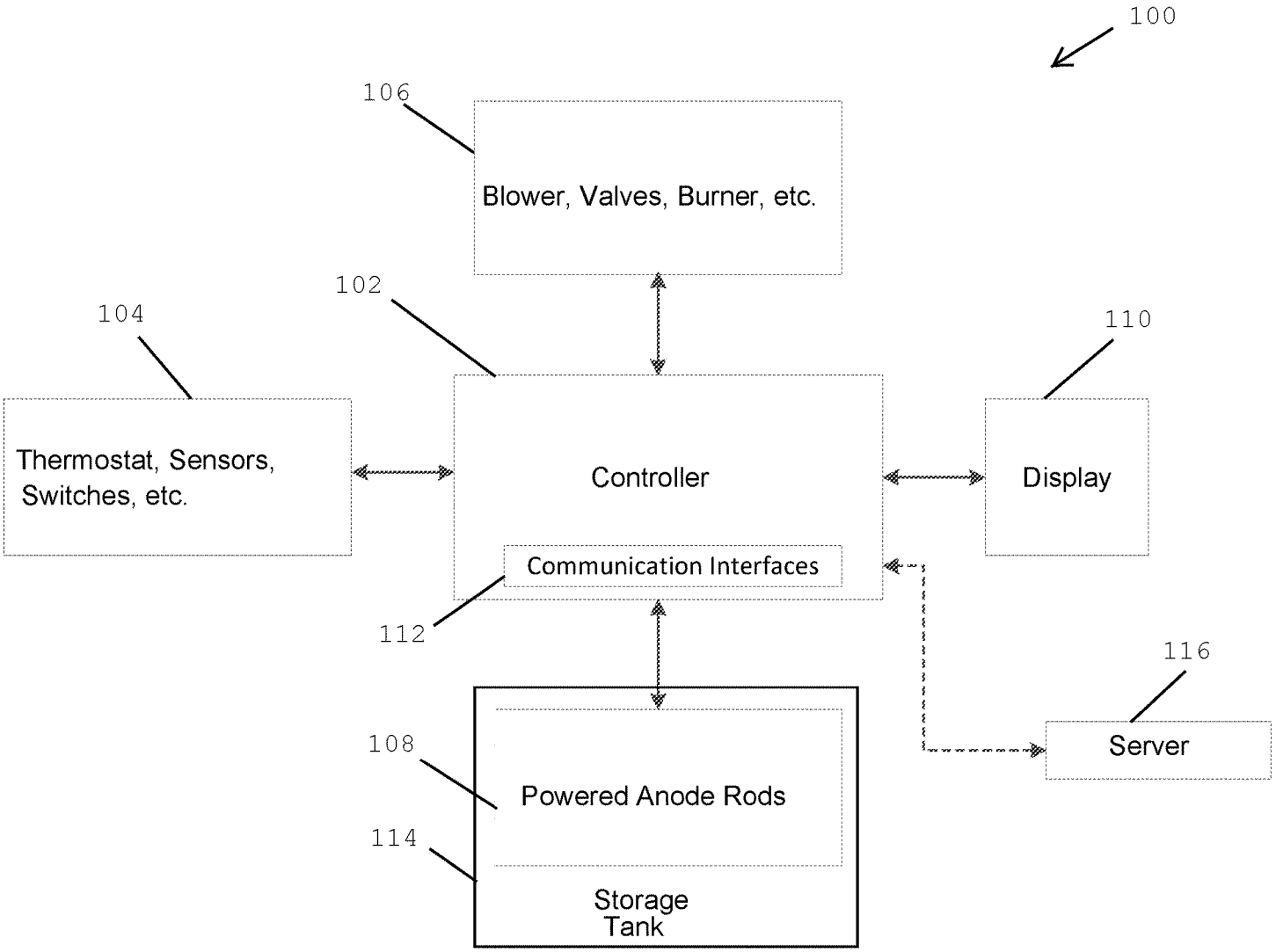
FIG. 1 illustrates a water heater system including a water heater monitoring and notification system according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION OF THE EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates a water heater system 100 including a water heater monitoring and notification system according to an example embodiment. In some example embodiments, the water heater system 100 includes a controller 102, a first group of water heat components 104, a second group of water heat components 106, and powered anodes 108 that are shown positioned in a water tank 114. The water heater system 100 may also include a display device 110 that can be used to provide notifications and to receive user input. For example, the display device 110 may be a touch-sensitive LCD display device, an LED-based display that has a user input interface, etc.

In some example embodiments, the controller 102 may be part of the monitoring and notification system of the water heater system 100. For example, the controller 102 may receive information from one or more of the first group of water heater components 104, the second group of water heater components 106, and the powered anodes 108, and provide notifications via the display device 110 and/or by transmitting notifications wirelessly or via one or more wired connections.

In some example embodiments, the controller 102 may include one or more communication interfaces 112. For example, the one or more communication interfaces 112 may include circuity for wireless communication (e.g., Wi-Fi communication) and/or for wired communication. To illustrate, the controller 102 may communicate with a server 116 wirelessly (e.g., via a Wi-Fi router) or via a wired connection (e.g., Ethernet connection). For example, the server 116 may be a local server or a cloud server. The controller 102 may also communicate with a mobile device, such as a mobile phone, a control system, such as a building management system, etc.

In some example embodiments, the first group of water heater components 104 may include sensors, switches, etc. For example, the first group of water heater components 104 may include a flame sensor, thermistors, integrated and/or external leak sensors, an intake pressure switch, an exhaust pressure switch, an emergency cutoff switch, etc. To illustrate, the controller 102 may receive information from the flame sensor, the intake pressure switch, the exhaust pressure switch, etc. and use the received information to control one or more components of the second group of water heater components 106. To illustrate, the second group of water heater components 106 may include a burner, a blower, valves, etc. that are controllable by the controller 102. The controller 102 may also receive information from the second group of water heater components 106, and some of the components of the first group of water heater components 104 may be controllable by the controller 102.

In some example embodiments, the controller 102 may process the information received from the first group of water heater components 104 and the second group of water heater components 106 to determine the particular notifications that may need to be provided to a user. For example, the controller 102 may provide notifications about the flame sensor of the water heater system 100, pressure switches of the water heater system 100, the blower of the water heater system 100, the one or more powered anode rods 108, etc. In some example embodiments, the controller 102 may process information provided by one or more components of the water heater system 100 to establish one or more reference ranges or thresholds that can be used to determine whether a component/system of the water heater system 100 is operating satisfactorily or efficiently during subsequent operations.

In some example embodiments, the controller 102 may include one or more microcontrollers or microprocessors that execute software code stored in one or more non-transitory memory devices to perform the functions of the controller 102. For example, the controller 102 may include or may be communicably coupled to a non-volatile memory device containing executable software code.

By monitoring the different components of the water heater system 100, the controller 102 may provide notifications to a user about the condition of a particular component of the water heater system 100 and/or the water heater system 100 in general. Such notifications may enable a user to take timely actions to improve efficiency of the water heater system 100, more easily identify defects with the water heater system 100, and avoid failures of the water heater system 100.

In some example embodiments, the controller 102, the display device 110, and other components may serve as part of the monitoring and notification system of the water heater system 100. In some example embodiments, the water heater system 100 includes components other than shown in FIG. 1 without departing from the scope of this disclosure. In some example embodiments, the controller 102, the groups of water heater components 104, 106, the display device 110, and other components of the water heater system 100 may be at various locations on or near the water tank 114. In some alternative embodiments, the display device 110 may be integrated with the controller 102. In some alternative embodiments, the display device 110 may be omitted without departing from the scope of this disclosure. In some alternative embodiments, the controller 102 may include a user input interface separate from the communication interfaces 112. In some example embodiments, one or more components of the water heater system 100 may be omitted without departing from the scope of this disclosure. For example, the water heater system 100 may include just one anode rod.

Figure 2:
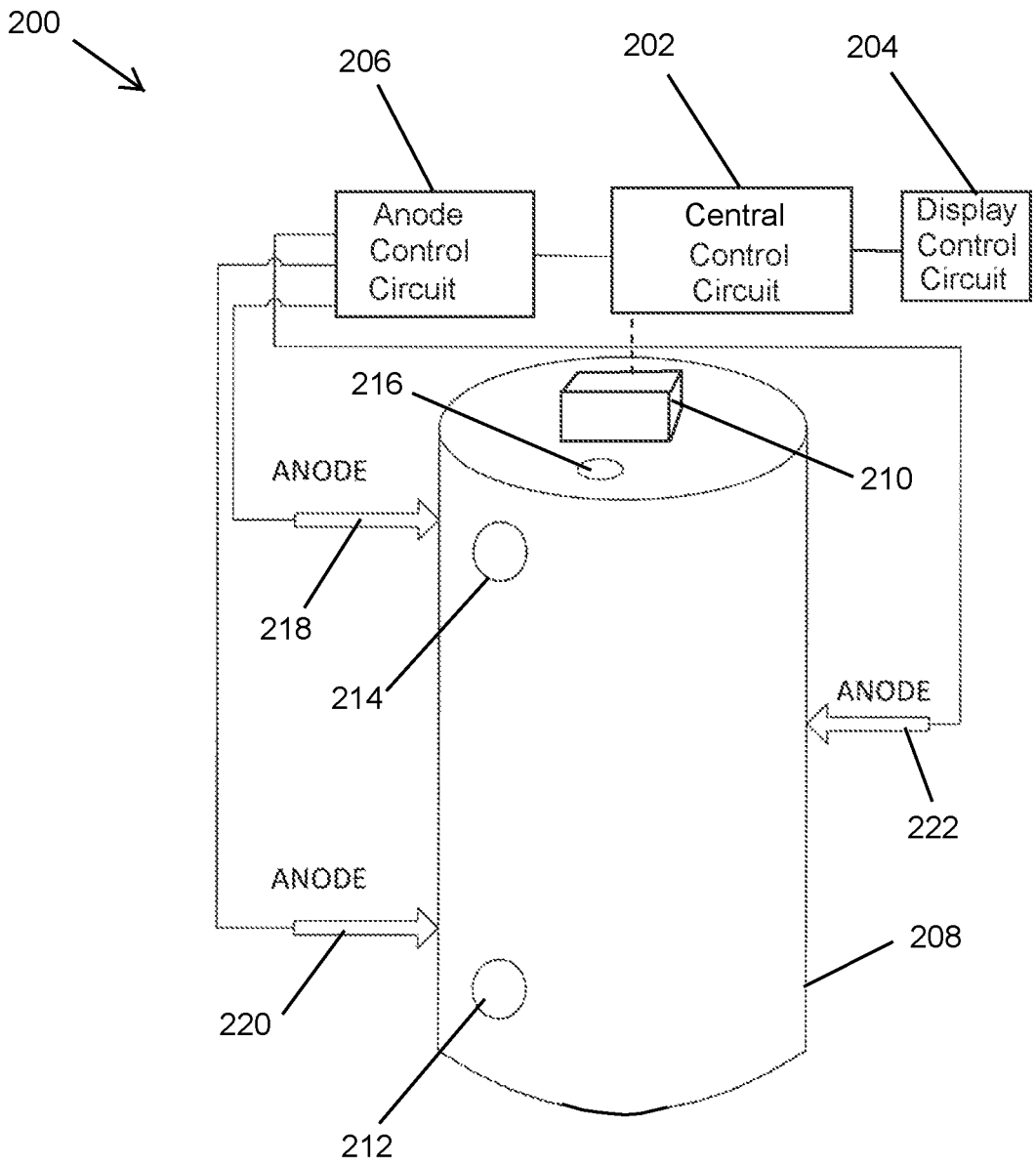
FIG. 2 illustrates a water heater system including a water heater monitoring and notification system according to another example embodiment.

FIG. 2 illustrates a water heater system 200 including a water heater monitoring and notification system according to another example embodiment. In some example embodiments, the water heater system 200 corresponds to the water heater system 100 of FIG. 1. In some example embodiments, the water heater system 200 may include a central control circuit 202, a display control circuit 204, and an anode control circuit 206. The water heater system 200 may also include a water tank 208, combustion system components 210, anode rods 218, 220, 222. For example, the controller 102 of FIG. 1 may include the central control circuit 202, the display control circuit 204, and the anode control circuit 206. In some example embodiments, the water tank 208 may correspond to the water tank 114 of FIG. 1, and the anode rods 218, 220, 222 may correspond to the anode rods 108 of FIG. 1.

In some example embodiments, the water tank 208 may include a water inlet opening 212 and a water outlet opening 214. In some example embodiments, a water outlet opening 216 may be used instead of the water outlet opening 214. In some alternative embodiments, the water inlet and water outlet openings of the water tank 208 may be at different locations than shown without departing from the scope of this disclosure.

In some example embodiments, the anode rods 218, 220, 222 may be positioned horizontally in the water tank 208. For example, the water tank 208 may have side openings for the insertion of the anode rods 218, 220, 222. In some alternative embodiments, the anode rods 218, 220, 222 may be vertical anode rods that are inserted through the top side of the water tank 208.

In some example embodiments, the anode control circuit 206 may control and monitor the operation of the anode rods 218, 220, 222. For example, the anode control circuit 206 may detect the amount of current for each of the anode rods 218, 220, 222 and process the information to determine whether one or more notifications should be provided to a user. For example, the anode control circuit 206 may compare a detected anode current to one or more thresholds to determine whether one or more notifications should be provided to a user. Alternatively, the anode control circuit 206 may provide the current information to the central control circuit 202 or to the display control circuit 204 that process the information to determine whether one or more notifications should be provided to a user. The one or more notifications may be provided to a user via the display interface of the display control circuit 204 and/or by transmitting the notifications wirelessly or via a wired connection to a server (e.g., the server 116 of FIG. 1), a mobile device, a building management system, etc.

In some example embodiments, the central control circuit 202 may receive information from the combustion system components 210. For example, the combustion system components 210 may include a blower (e.g., an inducer blower), a flame sensor, an intake pressure switch, an exhaust pressure switch, etc. The central control circuit 202 may process the received information to determine whether one or more notifications should be provided to a user by displaying at the water heater system 200 and/or transmitting (wirelessly or via a wired connection) the one or more notifications, for example, to a local, cloud and/or another server (e.g., the server 116 of FIG. 1), to a building management system that may include a server (e.g., the server 116 of FIG. 1), to a user's mobile device, etc.

In some example embodiments, the central control circuit 202 may provide the information received from the combustion system components 210 or the processed information to the display control circuit 204 that may process, display, and/or transmit the received and/or processed information. For example, the display control circuit 204 may include a touch-sensitive display that can be used to display information as well as to receive user input that can be used by the display control circuit 204, the central control circuit 202, etc. In some example embodiments, the display control circuit 204 may receive some information directly from the combustion system components 210 or from other components of the water heater system 200.

In some example embodiments, the central control circuit 202 may process information provided by one or more components of the combustion system components 210 or other components of the water heater system 200 to establish one or more reference ranges or thresholds that can be used to determine whether a component/system of the water heater system 100 is operating satisfactorily or efficiently during subsequent operations.

By monitoring the different components of the water heater system 200, the controller 102 may provide notifications to a user about the condition of a particular component of the water heater system 200 and/or the water heater system 100 in general. Such notifications may enable a user to take timely actions to improve efficiency of the water heater system 200, more easily identify defects, and avoid failures of the water heater system 200.

In some alternative embodiments, one or more of the central control circuit 202, the display control circuit 204, and the anode control circuit 206 may be integrated into a single circuit/device without departing from the scope of this disclosure. In some example embodiments, some components of the combustion system components 210 may be positioned at different locations on the storage tank 208 without departing from the scope of this disclosure. In some example embodiments, the water heater system 200 includes components other than shown in FIG. 2 without departing from the scope of this disclosure. In some example embodiments, the water heater system 200 may include a user input interface (e.g., a keyboard, knob, etc.) integrated with one or more of the control circuits 202, 204, 206. In some example embodiments, one or more components of the water heater system 200 may be omitted without departing from the scope of this disclosure. In some alternative embodiments, the water heater system 200 may include fewer or more anode rods than shown without departing from the scope of this disclosure.

Figure 3:
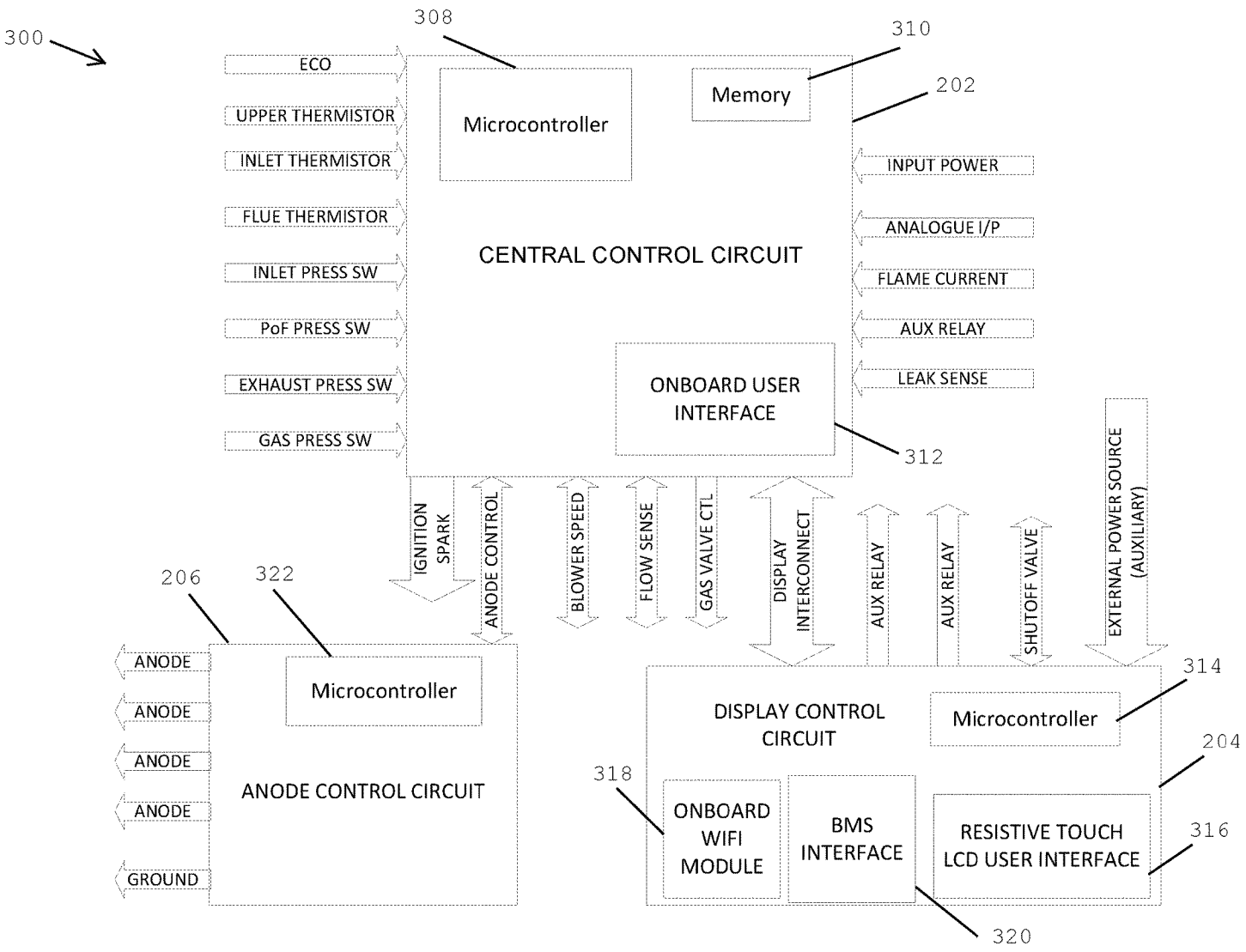
FIG. 3 illustrates a water heater monitoring and notification system according to an example embodiment.

FIG. 3 illustrates a water heater monitoring and notification system 300 according to an example embodiment. In some example embodiments, the water heater monitoring and notification system 300 corresponds to the controller 102 alone or together with the display device 110 shown in FIG. 1. Referring to FIGS. 2 and 3, the water heater monitoring and notification system 300 may include the central control circuit 202, the display control circuit 204, and the anode control circuit 206 of the water heater system 200 of FIG. 2. In some example embodiments, the central control circuit 202 includes a microcontroller 308, a memory device 310, and an onboard user interface 312. The microcontroller 308 may execute code stored in the memory device 310 and may retrieve and/or store data in the memory device 310 to perform operations of the central control circuit 202. For example, the memory device 310 may be a non-volatile memory device or another type of memory device. The onboard user interface 312 may be used to directly provide input the central control circuit 202.

In some example embodiments, the display control circuit 204 includes a microcontroller 314, a user interface 316 (e.g., a touch-sensitive LCD display interface), a Wi-Fi module 318, and a building management system (BMS) interface 320. In some example embodiments, the microcontroller 314 may execute code stored in a memory device of the display control circuit 204 or in another memory device to perform operations of the display control circuit 204. The user interface 316 may be used to provide notifications to a user and to receive user input for use by the system 300. The Wi-Fi module 318 may be used to wirelessly transmit notifications to a server, a mobile device, etc. In some alternative embodiments, the display control circuit 204 may include another wireless communication module instead of or in addition to the Wi-Fi module 318. In some example embodiments, the BMS interface 320 may be used to communicate with a BMS in compliance with the BMS requirements. In some alternative embodiments, the display control circuit 204 or one or more of the components of the display control circuit 204 may be integrated with the central control circuit 202 without departing from the scope of this disclosure.

In some example embodiments, the anode control circuit 206 includes a microcontroller 322 that may execute code stored in a memory device of the anode control circuit 206 or in another memory device to perform operations of the anode control circuit 206. The anode control circuit 206 may control the operation of the one or more anode rods, such as the anode rods 218, 220, 222 shown in FIG. 2. The anode control circuit 206 may also monitor the current (anode current) in each anode rod. For example, the anode control circuit 206 may detect the anode current in each anode rod and process the anode current to determine whether one or more notifications should be provided. Alternatively, the anode control circuit 206 may provide the anode current information to the central control circuit 202 that can process the anode current information to determine whether one or more notifications should be provided. The central control circuit 202 and the anode control circuit 206 may communicate the notification information to the display control circuit 204 for display and/or transmission to a user, etc. In some alternative embodiments, the anode control circuit 206 or one or more of the components of the anode control circuit 206 may be integrated with the central control circuit 202 without departing from the scope of this disclosure.

In some example embodiments, the central control circuit 202 receives inputs from an emergency cutoff switch, an upper thermistor, an inlet thermistor, a flue thermistor, an intake pressure switch, a proof-of-fan pressure switch, an exhaust pressure switch, and a flow detector of the water heater system 200. The central control circuit 202 may also receive a flame current information from a flame sensor, leak information from a leak detector, and blower speed information from a blower of the combustion system of the water heater system 200. The central control circuit 202 may receive the blower speed information in revolution per minute (RPM) of the blower or in another form.

In some example embodiments, the central control circuit 202 may control some operations of the water heater system 200. For example, the central control circuit 202 may control the opening and closing of the gas valve and the igniting of the burner of the combustion system.

In some example embodiments, the central control circuit 202 may determine a number of pre-purge durations of the combustion system of the water heater system 200 for the same number of pre-purge cycles (e.g., 30 cycles) and may determine an average pre-purge duration of the number of pre-purge durations. The central control circuit 202 may use the average pre-purge duration as a reference to determine whether subsequent pre-purge durations of the combustion system indicate a problem with the combustion system and provide relevant notifications. A pre-purge duration or duration of a pre-purge as used in this specification can be considered as the time period that the blower operates, after being started, until the proof-of-fan pressure switch closes.

In some example embodiments, the central control circuit 202 may receive flame current from the flame sensor, where the flame current corresponds to the maximum gas input rate for the combustion system. The central control circuit 202 may receive flame current for a number of ignition cycles and determine the minimum and maximum flame currents from among the multiple flame currents. The central control circuit 202 may use the minimum and maximum flame currents to determine whether the flame sensor is degraded and to provide notifications.

In some example embodiments, the central control circuit 202 may determine a pulse width of a PWM signal when the blower reaches the maximum specified speed of the blower. The central control circuit 202 may determine the pulse width of the PWM signal, which may control the blower speed, for a number of ignition cycles (e.g., 30 cycles) and may determine the average pulse width from the multiple pulse widths. The central control circuit 202 may use the average pulse width as a reference to determine whether the pulse width of the PWM signal in subsequent operations is within one or more ranges of the average pulse width and provide relevant notifications about the combustion system of the water heater system 200. In some alternative embodiments, the central control circuit 202 uses another parameter of the PWM signal instead of the pulse width to provide relevant notifications about the combustion system of the water heater system 200.

In some example embodiments, the central control circuit 202 may receive information indicating that the intake pressure switch or the exhaust pressure switch is open. The central control circuit 202 may determine that the intake pressure switch or the exhaust pressure switch of the exhaust/combustion system of the water heater system 200 may be defective and may provide relevant notifications.

In some example embodiments, the central control circuit 202, the display control circuit 204, and the anode control circuit 206 may communicate with each other to perform the operations of the water heater monitoring and notification system 300. In some alternative embodiments, two or more of the central control circuit 202, the display control circuit 204, and the anode control circuit 206 may be integrated into a single component/device such as the controller 102 of FIG. 1. In some alternative embodiments, the water heater monitoring and notification system 300 may have other components in addition to and/or instead of the components shown in FIG. 3 without departing from the scope of this disclosure. In general, the central control circuit 202, the display control circuit 204, and the anode control circuit 206 may include other components, such as an analog-to-digital and a digital-to-analog converter, as can be readily understood by those of ordinary skill in the art with the benefit of this disclosure. In some alternative embodiments, one or more components of the water heater monitoring and notification system 300 may be omitted without departing from the scope of this disclosure.

Figure 4:
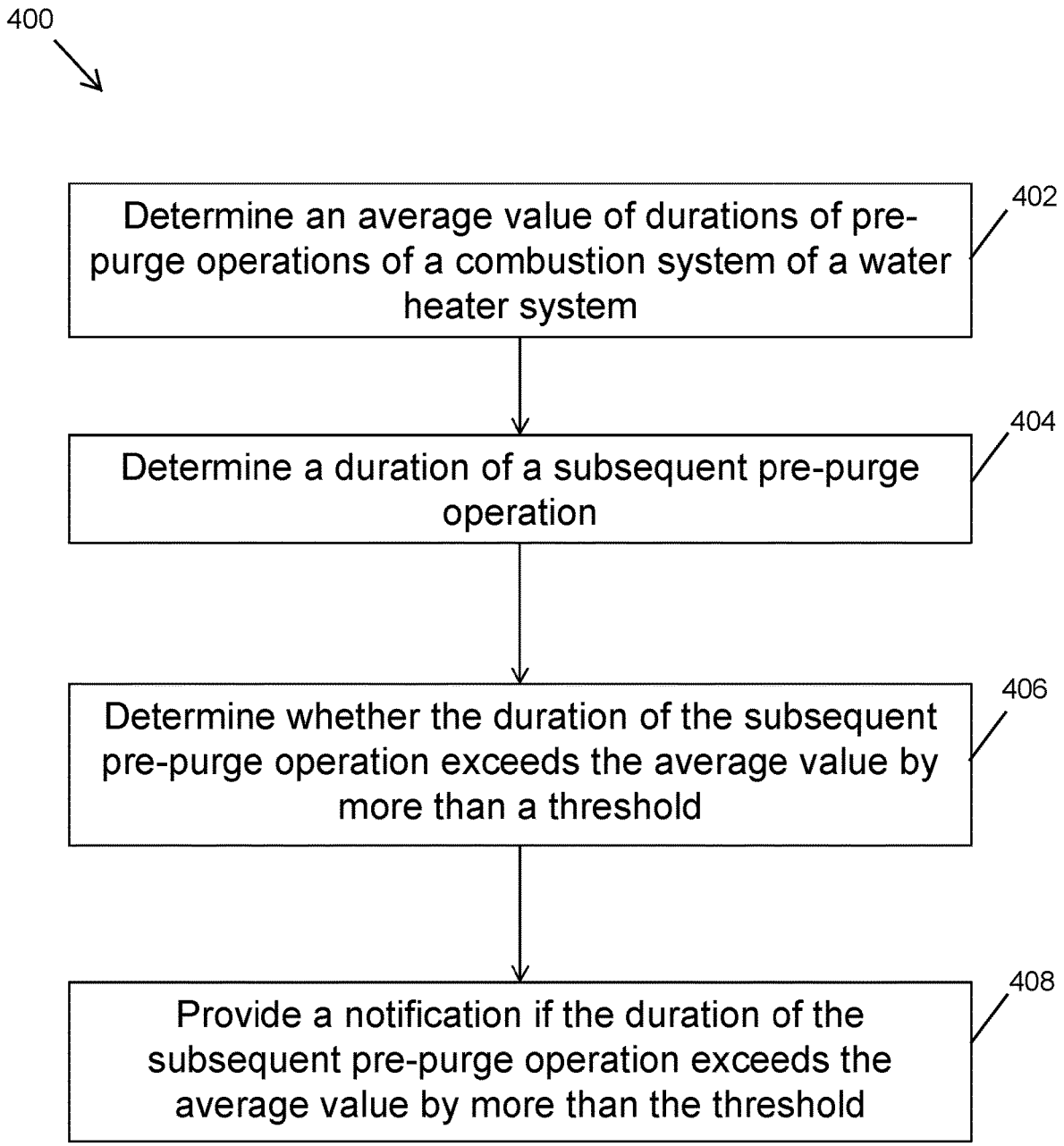
FIG. 4 illustrates a method of monitoring and notification of water heater system conditions according to an example embodiment.

FIG. 4 illustrates a method 400 of monitoring and notification of water heater system conditions according to an example embodiment. Referring to FIGS. 1-4, in general, the method 400 determines whether the blower of the combustion system of a water heater system, such as the water heater system 100, 200, is degraded based on the pre-purge duration where the blower is energized to clear the combustion system until the proof-of-fan (PoF) switch is closed. Unless the PoF pressure switch is itself degraded, because the time for the PoF pressure switch to close should remain relatively constant in the absence of physical changes to the blower, the controller 102 or the monitoring and notification system 300 may use information related to the pre-purge duration (e.g., the time it takes for the PoF pressure switch to close after the blower is energized) to determine whether the blower is degraded.

In some example embodiments, the method 400 includes, at step 402, determining an average value (i.e., pre-purge duration average value) of durations of pre-purge operations of a combustion system of a water heater system. For example, the controller 102 or the central control circuit 202 may determine an average value of durations of pre-purge operations. To illustrate, the controller 102 or the central control circuit 202 may determine durations for multiple pre-purge operations (e.g., 30 pre-purge durations) following a powering up of the water heater system 100, 200. For example, the controller 102 or the central control circuit 202 may use a timer or may perform the function of a timer to determine durations of the multiple pre-purge operations.

The controller 102 or the central control circuit 202 may then determine the average value of the durations of the multiple pre-purge operations.

At step 404, the method 400 may include determining a duration of a subsequent pre-purge operation that is performed after the average value of the durations of the multiple pre-purge operations is determined. For example, the controller 102 or the central control circuit 202 may determine the duration of the subsequent pre-purge operation.

At step 406, the method 400 may include determining whether the duration of the subsequent pre-purge operation equals or exceeds the average value by more than a threshold, which may be performed by the controller 102 or the central control circuit 202. The threshold may be, for example, 1 second, 1.5 seconds, 2 seconds, or another value that may be appropriate depending on the particular blower, combustion system, or water heater system. The controller 102 or the central control circuit 202 may to the same effect determine whether the duration of the subsequent pre-purge operation equals or is less than the sum of the average value and the threshold.

At step 408, the method 400 includes providing a notification if the duration of the subsequent pre-purge operation exceeds (alternatively, equals or exceeds) the average value by more than the threshold. For example, the controller 102 or the display control circuit 204 may provide a notification indicating that the blower of the water heater system 100, 200 may be degraded. The notification may be provided to a user, owner, etc. via a display of the water heater system (e.g., the display device 110, the user interface 316, or another display device). For example, the background color of the display may be changed to provide the notification. The notification may alternatively or in addition be transmitted wirelessly or via a wired connection to a BMS, a mobile device that may include a relevant software application, to a local or cloud server, etc. In some example embodiments, the notification may be an audio notification instead of or in addition to visual and/or transmitted notification.

In some example embodiments, the method 400 may include determining, for example, by the controller 102 or the central control circuit 202, the extent of the deviation of durations of subsequent pre-purge operations from the average value (i.e., pre-purge duration average value). To illustrate, the deviation of duration of a subsequent pre-purge operation from the average value may be the difference between the duration of the subsequent pre-purge operation and the average value. In some example embodiments, the absolute value of the deviation may be considered for further processing such that the deviation above and below the average value are treated equally in determining whether the blower of the water heater system 100, 200 or the combustion system is degraded or requires service. In some example embodiments, the deviation may be considered as a percentage of the average value. For example, considering normalized values where the average value is normalized to one (1), a duration of the subsequent pre-purge operation that is 0.95 has a deviation of 5% from the average value. In some example embodiments, one or more notifications may be provided based on the deviation(s) of the duration(s) of one or more subsequent pre-purge operations from the pre-purge duration average value. The notifications may be given using one or more methods described above.

In some example embodiments, the method 400 may continue with the steps 404-408 for further subsequent pre-purge operations. In some example embodiments, the method 400 may include clearing the displayed notification, for example, in response to a user input that may be received from a remote device/system or via the user interface of the water heater system 100, 200. In some example embodiments, the microcontroller 308 of FIG. 3 and/or another microcontroller may execute software code stored in the memory device 310 and/or in another memory device of the water heater system 100, 200, and/or retrieved from a local or cloud server (e.g., the server 116) to perform the steps of the method 400. The microcontroller 308 of FIG. 3 and/or another microcontroller may also use and store data from/to the memory device 310 and/or in another memory device of the water heater system 100, 200, and/or retrieved/store from/to a local or cloud server (e.g., the server 116) to perform the steps of the method 400. In some example embodiments, the method 400 may include steps other than shown in FIG. 4 without departing from the scope of this disclosure.

In some example embodiments, one or more steps of the method 500 may be omitted without departing from the scope of this disclosure. In some example embodiments, the method 500 may include additional steps than described without departing from the scope of this disclosure. In some example embodiments, the steps of the method 500 may be performed in a different order than described above without departing from the scope of this disclosure.

Figure 5:
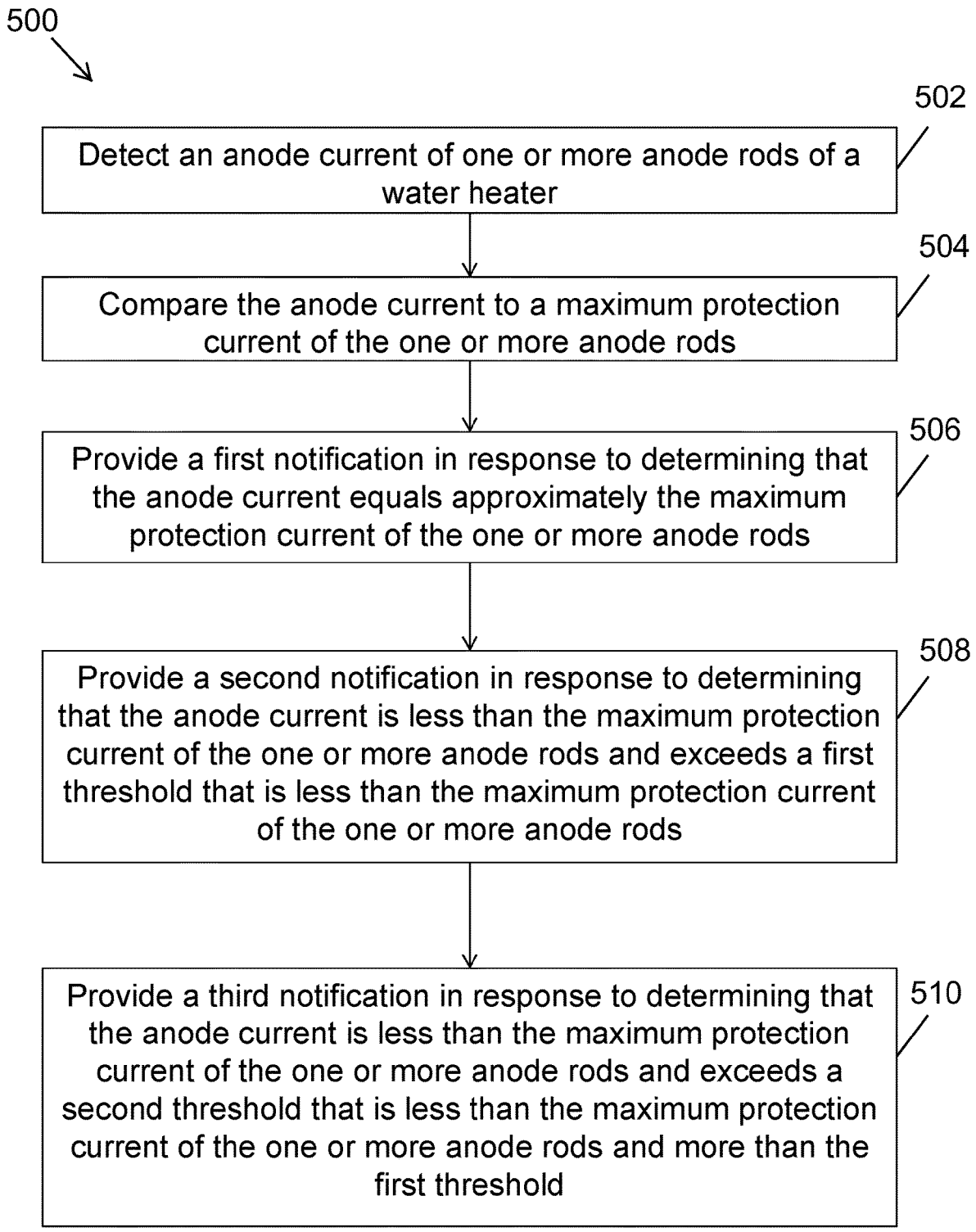
FIG. 5 illustrates a method of monitoring and notification of water heater system conditions according to another example embodiment.

FIG. 5 illustrates a method 500 of monitoring and notification of water heater system conditions according to another example embodiment. Referring to FIGS. 1-3 and 5, in general, the method 500 determines the level of protection available to a water heater system from a powered anode system based on the current of the powered anode system. For example, a powered anode system may include one or more powered anode rods such as the one or more anode rods 108, the anode rods 218, 220, 222, or other powered anode rods. To illustrate, a relatively higher current of one or more powered anode rods may indicate that a relatively lower protection is provided by the one or more powered anode rods against corrosion of the water tank.

In some example embodiments, the method 500 includes, at step 502, detecting/determine an anode current of one or more anode rods of a water heater system, such as the water heater system 100, 200. For example, the controller 102 or the anode control circuit 206 may determine/detect the anode current in the one or more powered anode rods, such as one of the anode rods 108 or one of the anode rods 218, 220, 222.

At step 504, the method 500 may include comparing the anode current to a maximum protection current of the one or more anode rods. For example, the controller 102 or the anode control circuit 206 may compare the anode current to the maximum protection current of the one or more anode rods. To illustrate, the maximum protection current of the one or more anode rods may be obtained from a memory device of the water heater system 100, from a server (e.g., the server 116), etc. or may be calculated from information from the memory device, from the server, etc.

At step 506, the method 500 may include providing a first notification in response to determining that the anode current equals approximately the maximum protection current of the one or more anode rods. For example, the first notification may indicate that the protection limit provided by one or more anode rods has been reached.

At step 508, the method 500 may include providing a second notification in response to determining that the anode current exceeds a threshold that is less than the maximum protection current of the one or more anode rods and is less than the maximum protection current of the one or more anode rods. For example, the threshold may be 90% or another percentage of the maximum protection current of the one or more anode rods. The method 500 may also include providing other notifications based on the comparison of the anode current to different thresholds.

At step 510, the method 500 may include providing a third notification in response to determining that the anode current exceeds a threshold that is less than the maximum protection current of the one or more anode rods and is less than the maximum protection current of the one or more anode rods. For example, the threshold may be 98% or another percentage of the maximum protection current of the one or more anode rods. The method 500 may also include providing other notifications based on the comparison of the anode current to different thresholds.

In some example embodiments, the controller 102, the display control circuit 204, or another component of the water heater systems 100, 200 may provide the first, second, and third notifications as well as other notifications to a user, owner, etc. via a display of the water heater system (e.g., the display device 110, the user interface 316, or another display device). For example, the color of the display (e.g., an icon or an area of the display) may be changed to a color associated with a particular notification. The notifications may alternatively or in addition be transmitted wirelessly or via a wired connection to a BMS, a mobile device that may include a relevant software application, to a local or cloud server, etc. In some example embodiments, the notifications may be audio notifications instead of or in addition to visual and/or transmitted notifications.

In some example embodiments, the method 500 includes determining an initial anode current of the one or more anode rods, for example, immediately the initial powering up of the water heater system or after installation of one or more new anode rods. After determining the initial anode current, the method 500 may also include comparing the initial anode current with one or more thresholds (e.g., a percentage of the maximum protection current of the one or more anode rods, etc.) to assess the condition of the water in the water tank of the water heater system and/or the condition of the water tank itself. For example, the controller 102 or the anode control circuit 206 may determine the initial anode current and perform the comparison to the one or more thresholds.

In some example embodiments, an initial anode current that exceeds an initial condition threshold may indicate that the water has low conductivity or that the lining of the water tank is damaged. An initial anode current that is less than the same initial condition threshold or another threshold may indicate that the water in the water tank may be hard water (i.e., water that has high conductivity). The information about the water and/or tank conditions may be stored in a memory device of the controller 102, the system 300, etc. and/or may be provided the information to a server, etc. In some example embodiments, data regarding the expected life of the one or more anodes and the water quality may be retrieved, for example, by the controller 102, based on zip code or other location information provided to a user. In some example embodiments, notifications may be provided to a user in a similar manner as described above with respect to the water and/or tank conditions.

In some example embodiments, the microcontroller 308 of FIG. 3 and/or another microcontroller may execute software code stored in the memory device 310 and/or in another memory device of the water heater system 100, 200, and/or retrieved from a local or cloud server (e.g., the server 116) to perform the steps of the method 500. The microcontroller 308 of FIG. 3 and/or another microcontroller may also use and store data from/to the memory device 310 and/or in another memory device of the water heater system 100, 200, and/or retrieve/store from/to a local or cloud server (e.g., the server 116) in performing the steps of the method 500.

In some example embodiments, one or more steps of the method 500 may be omitted without departing from the scope of this disclosure. In some example embodiments, the method 500 may include additional steps than described above or shown in FIG. 5 without departing from the scope of this disclosure. In some example embodiments, some steps of the method 500 may be performed in a different order than described above without departing from the scope of this disclosure.

Figure 6:
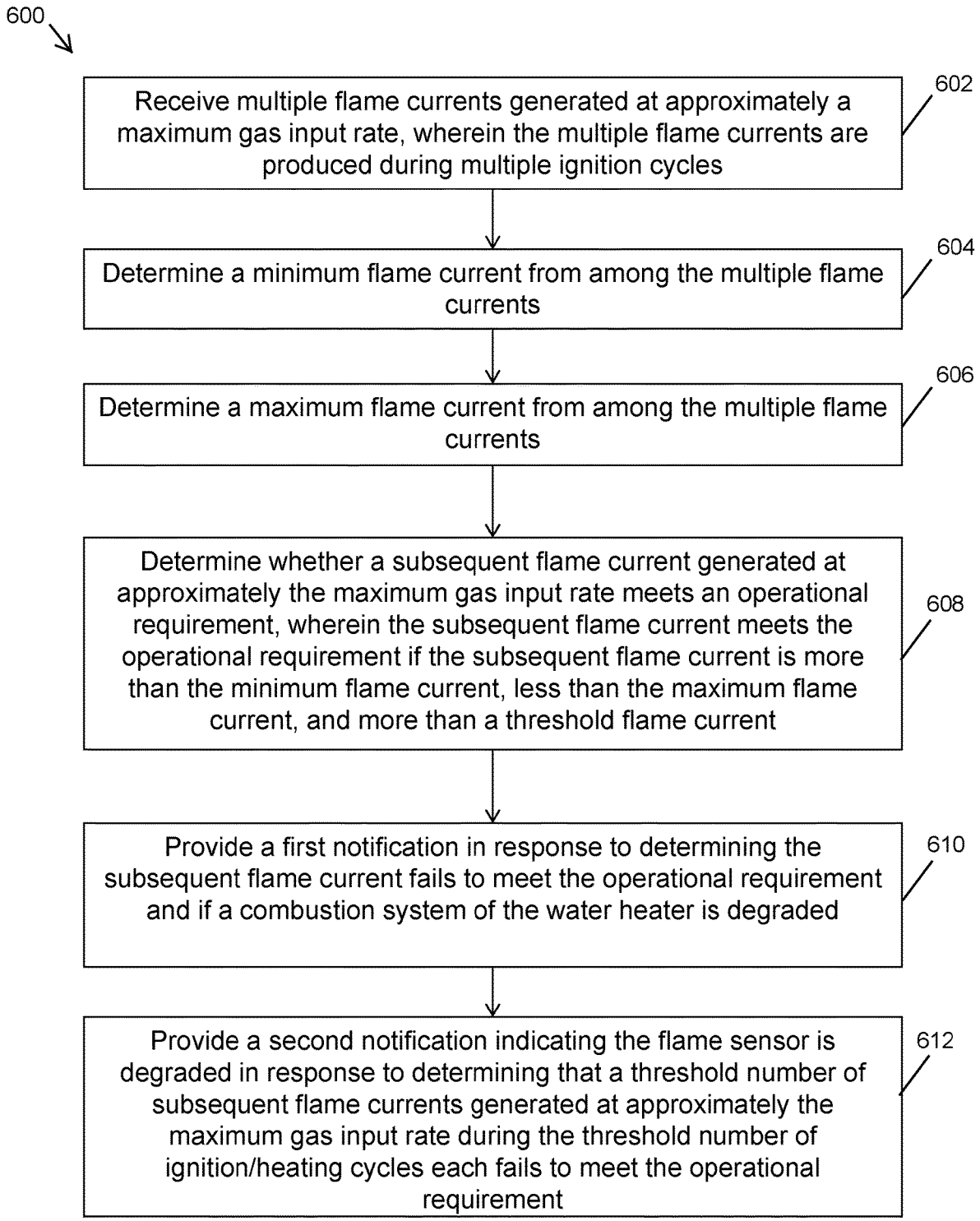
FIG. 6 illustrates a method of monitoring and notification of water heater system conditions according to another example embodiment.

FIG. 6 illustrates a method 600 of monitoring and notification of water heater system conditions according to another example embodiment. Referring to FIGS. 1-3 and 6, in general, the method 600 determines if the flame rod of a water heater combustion system is degraded or degrading, for example, due to oxidation in the combustion environment. The method 600 may include establishing reference ranges or boundaries, for example, immediately after initial installation of the water heater system, such as the water heater systems 100, 200.

In some example embodiments, the method 600 includes, at step 602, receiving multiple flame currents generated at approximately a maximum gas input rate. The multiple flame currents are produced during multiple ignition cycles. The multiple flame currents may be determined, for example, at initial powering up of the water heater system. To illustrate, during a particular ignition cycle following the powering up of the combustion system of a water heater system, a flame sensor of the water heater system may provide the flame current to, for example, the controller 102 or to the central control circuit 202. By repeating the process of providing the flame current to the controller 102, the central control circuit 202, or another component, multiple flame currents corresponding to approximately the maximum gas input rate may be determined for multiple ignition cycles (e.g., 30 successful ignition cycles). The determination of whether the gas input rate has reached the maximum gas input rate may be made by the controller 102, the central control unit 202, or by another component, for example, based on the control of the gas input rate, an indicator from a sensor/switch, or by other means as can be readily contemplated by those of ordinary skill in the art with the benefit of this disclosure.

At step 604, the method 600 may include determining a minimum flame current from among the multiple flame currents determined at step 602. At step 606, the method 600 may include determining a maximum flame current from among the multiple flame currents. At step 608, the method 600 may include determining whether a subsequent flame current generated during a subsequent ignition/heating cycle at approximately the maximum gas input rate meets an operational requirement. The subsequent flame current may be determined in a similar manner as the multiple flame currents. In some example embodiments, the subsequent flame current meets the operational requirement when the subsequent flame current is more than the minimum flame current, less than the maximum flame current, or more than a threshold flame current (e.g., 0.5 microamperes). For example, the controller 102 or the central control logic 202 may determine whether the subsequent flame current meets the operational requirement.

At step 610, the method 600 may include providing a first notification in response to determining that the subsequent flame current fails to meet the operational requirement and if a combustion system of the water heater is degraded. For example, whether the combustion system is degraded may be determined as described with respect to FIG. 7. The first notification may indicate that the combustion system or the flame sensor may be degraded, defective, etc.

At step 612, the method 600 may include providing a second notification indicating the flame sensor is degraded in response to determining that a threshold number of subsequent flame currents generated at approximately the maximum gas input rate during the threshold number of ignition/heating cycles each failed to meet the operational requirement. For example, the threshold number may be three, four, or a higher or lower number that may be suitable for the particular type of combustion system. The second notification may indicate that the flame sensor may be degraded, defective, etc.

In some example embodiments, the controller 102, the display control circuit 204, or another component of the water heater systems 100, 200 may provide the notifications to a user, owner, etc. via a display of the particular water heater system (e.g., the display device 110, the user interface 316, or another display device). For example, the color of the display (e.g., an icon or an area of the display) may be changed to a color associated with a particular notification. The notifications may alternatively or in addition be transmitted wirelessly or via a wired connection to a BMS, a mobile device that may include a relevant software application, to a local or cloud server, etc. In some example embodiments, the notifications may be an audio notification instead of or in addition to visual and/or transmitted notifications.

In some example embodiments, the method 600 includes determining, for example, by the controller 102 or the central control circuit 202, an average value of the multiple flame currents (i.e., flame current average value), where the multiple flame currents are generated at approximately a maximum gas input rate during the multiple ignition cycles, such as following initial powering up of the water heater system as described above. For example, the multiple flame currents used to determine the average flame current value may correspond to 30 or another number of successful ignition cycles.

In some example embodiments, the method 600 may include determining, for example, by the controller 102 or the central control circuit 202, the extent of the deviation of subsequent flame currents (for example, flame currents determined during ignition cycles after the multiple ignition cycles corresponding to the flame currents used to determine the flame current average value) from the flame current average value, where the subsequent flame currents are determined at approximately a maximum gas input rate. To illustrate, the deviation from the average value may be the difference between a subsequent flame current determined at approximately a maximum gas input rate and the flame current average value. In some example embodiments, the absolute value of the deviation may be considered for further processing such that the deviation above and below the flame current average value are treated equally in determining whether the combustion system is degraded or requires service. In some example embodiments, the deviation may be considered as a percentage of the average value. For example, considering normalized values where the average value is normalized to one (1), a subsequent flame current that is 0.85 has a deviation of 15% from the average value. In some example embodiments, one or more notifications may be provided based on the deviation(s) of one or more subsequent flame currents from the flame current average value. The notifications may be given using one or more methods described above.

In some example embodiments, the microcontroller 308 of FIG. 3 and/or another microcontroller may execute software code stored in the memory device 310 and/or in another memory device of the water heater system 100, 200, and/or retrieved from a local or cloud server (e.g., the server 116) to perform the steps of the method 600. The microcontroller 308 of FIG. 3 and/or another microcontroller may also use and store data from/to the memory device 310 and/or in another memory device of the water heater system 100, 200, and/or retrieve/store from/to a local or cloud server (e.g., the server 116) in performing the steps of the method 600.

In some example embodiments, one or more steps of the method 600 may be omitted without departing from the scope of this disclosure. In some example embodiments, the method 600 may include additional steps than described above or shown in FIG. 6 without departing from the scope of this disclosure. In some example embodiments, some steps of the method 600 may be performed in a different order than described above without departing from the scope of this disclosure.

Figure 7:
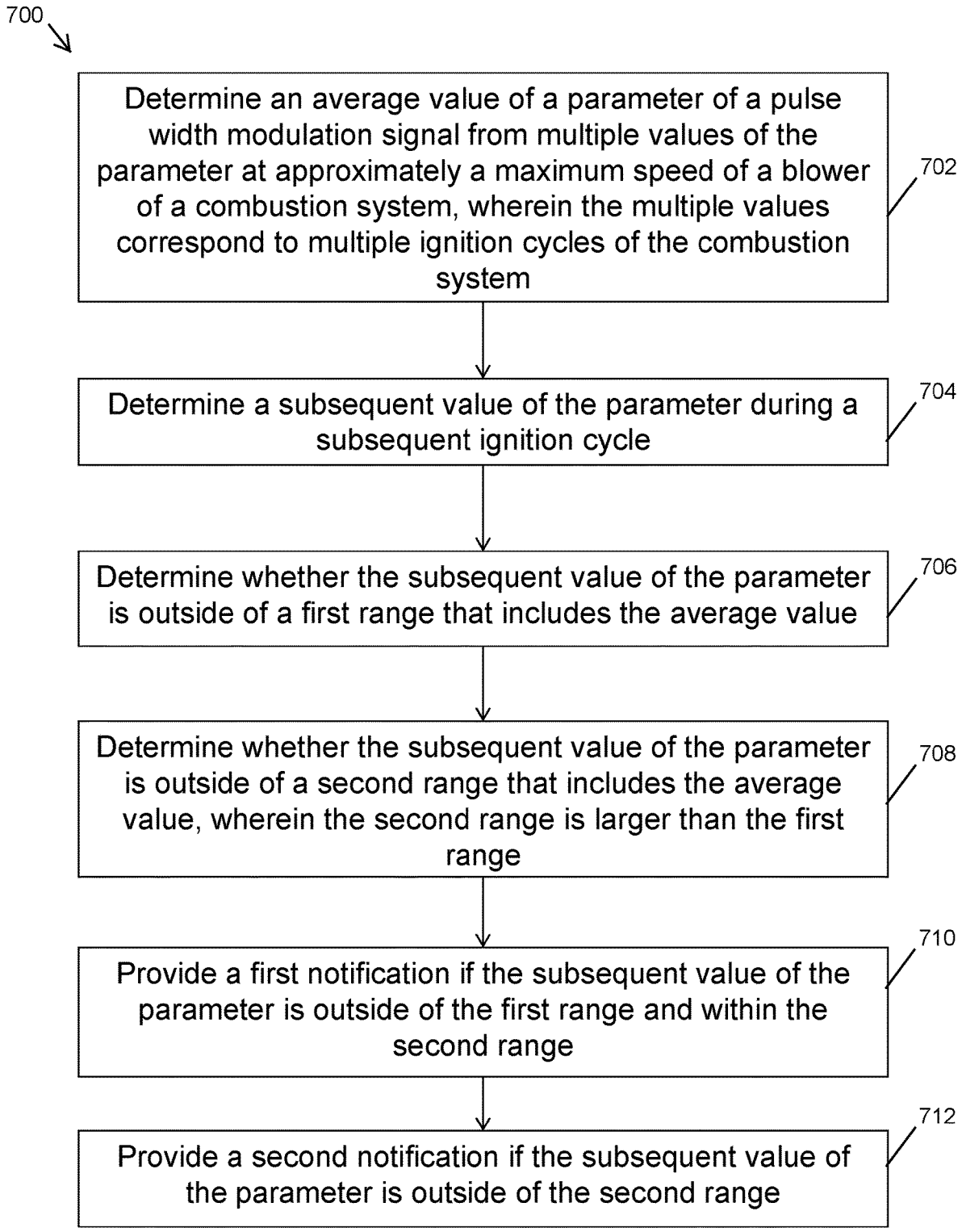
FIG. 7 illustrates a method of monitoring and notification of water heater system conditions according to another example embodiment.

FIG. 7 illustrates a method 700 of monitoring and notification of water heater system conditions according to another example embodiment. Referring to FIGS. 1-3 and 7, in general, the method 700 determines if the combustion system of a water heater system, such as the water heater systems 100, 200, is degraded based on the relationship between the speed of the blower of the combustion system and a pulse width modulation (PWM) signal that can be used to adjust the speed of the blower.

In some example embodiments, the method 700 includes, at step 702, determining an average value of a parameter of a PWM signal (i.e., PWM parameter average value), where the average value is determined from multiple values of the parameter at approximately a maximum speed of the blower. The multiple values of the parameter correspond to multiple ignition cycles of the combustion system. To illustrate, the multiple values of a parameter of the PWM signal may be determined during multiple ignition cycles (e.g., 30 successful ignition cycles) of the combustion system when the blower is operating at a maximum speed (e.g., revolution per minute (RPM)) during each ignition cycle. The parameter may be the pulse width of the PWM signal, where the blower speed may depend on the value of the pulse width. In some example embodiments, the controller 102 or the central control circuit 202 may determine the multiple values of the parameter and the average value of the parameter from the multiple values. For example, the controller 102 of FIG. 1 may receive from the blower an input indicating the blower speed.

At step 704, the method 700 may include determining a value of the parameter during a subsequent ignition/heating cycle, where the subsequent value is determined at approximately the maximum speed of the blower.

At step 706, the method 700 may include determining whether the subsequent value of the parameter is outside of a first range that includes the average value of the parameter, which may indicate that the combustion system is degraded. For example, the controller 102 or the central control circuit 202 may determine pulse width of the PWM signal during subsequent ignition/heating cycle, at approximately the maximum speed of the blower, and whether the subsequent value of the parameter is outside of the first range. The first range may be defined by a particular percentage (e.g., 5%) of the average value above and below the average value. Alternatively, the first range may be defined by other limits that may be the same or different above and below the average value.

At step 708, the method 700 may include determining whether the subsequent value of the parameter is outside of a second range that includes the average value, where the second range may be larger than the first range, which may indicate that the combustion system is degraded. The second range may be defined by another percentage (e.g., 10%) of the average value above and below the average value. For example, the controller 102 or the central control circuit 202 may determine whether the subsequent value of the parameter is outside of the second range in response to determining that the subsequent value of the parameter is outside of the first range.

At step 710, the method 700 may include providing a first notification if the subsequent value of the parameter is outside of the first range and within the second range. For example, the first notification may indicate that the operation of the combustion system is sub-optimal. At step 712, the method 700 may include providing a second notification if the subsequent value of the parameter is outside of the second range. For example, the second notification may indicate that the combustion system requires an inspection, for example, by a service provider.

In some example embodiments, the controller 102, the display control circuit 204, or another component of the water heater systems 100, 200 may provide the notifications to a user, owner, etc. via a display of the particular water heater system (e.g., the display device 110, the user interface 316, or another display device). For example, the color of the display (e.g., an icon or an area of the display) may be changed to a color associated with a particular notification. The notifications may alternatively or in addition be transmitted wirelessly or via a wired connection to a BMS, a mobile device that may include a relevant software application, to a local or cloud server, etc. In some example embodiments, the notifications may be audio notifications instead of or in addition to visual and/or transmitted notifications.

In some example embodiments, the method 700 may include determining, for example, by the controller 102 or the central control circuit 202, the extent of the deviation of the value of the parameter during subsequent ignition/heating cycles from the average value of the parameter of the PWM signal (i.e., the PWM parameter average value) determined based on the multiple ignition/heating cycles as described above. To illustrate, for each subsequent ignition/heating cycle, the deviation from the PWM parameter average value may be the difference between the value of the parameter during the subsequent ignition/heating cycle and the PWM parameter average value. In some example embodiments, the absolute value of the deviation may be considered for further processing such that the deviation above and below the PWM parameter average value are treated equally in determining whether the combustion system is degraded or requires service. In some example embodiments, the deviation may be considered as a percentage of the PWM parameter average value. For example, considering normalized values where the average value is normalized to one (1), a value of the parameter of the PWM signal during a subsequent ignition/heating cycle that is 0.93 has a deviation of 7% from the average value of the parameter of the PWM signal. As described above, the parameter of the PWM signal may be the pulse width of the PWM signal, which may be expressed in one of several forms including duty cycle, time, etc. In some example embodiments, one or more notifications may be provided based on the deviation of the value of the parameter of the PWM signal during one or more subsequent ignition/heating cycles from the PWM parameter average value.

In some example embodiments, the microcontroller 308 of FIG. 3 and/or another microcontroller may execute software code stored in the memory device 310 and/or in another memory device of the water heater system 100, 200, and/or retrieved from a local or cloud server (e.g., the server 116) to perform the steps of the method 700. The microcontroller 308 of FIG. 3 and/or another microcontroller may also use and store data from/to the memory device 310 and/or in another memory device of the water heater system 100, 200, and/or retrieve/store from/to a local or cloud server (e.g., the server 116) in performing the steps of the method 700.

In some example embodiments, one or more steps of the method 700 may be omitted without departing from the scope of this disclosure. In some example embodiments, the method 700 may include additional steps than described above or shown in FIG. 7 without departing from the scope of this disclosure. In some example embodiments, some steps of the method 700 may be performed in a different order than described above without departing from the scope of this disclosure.

Figure 8:
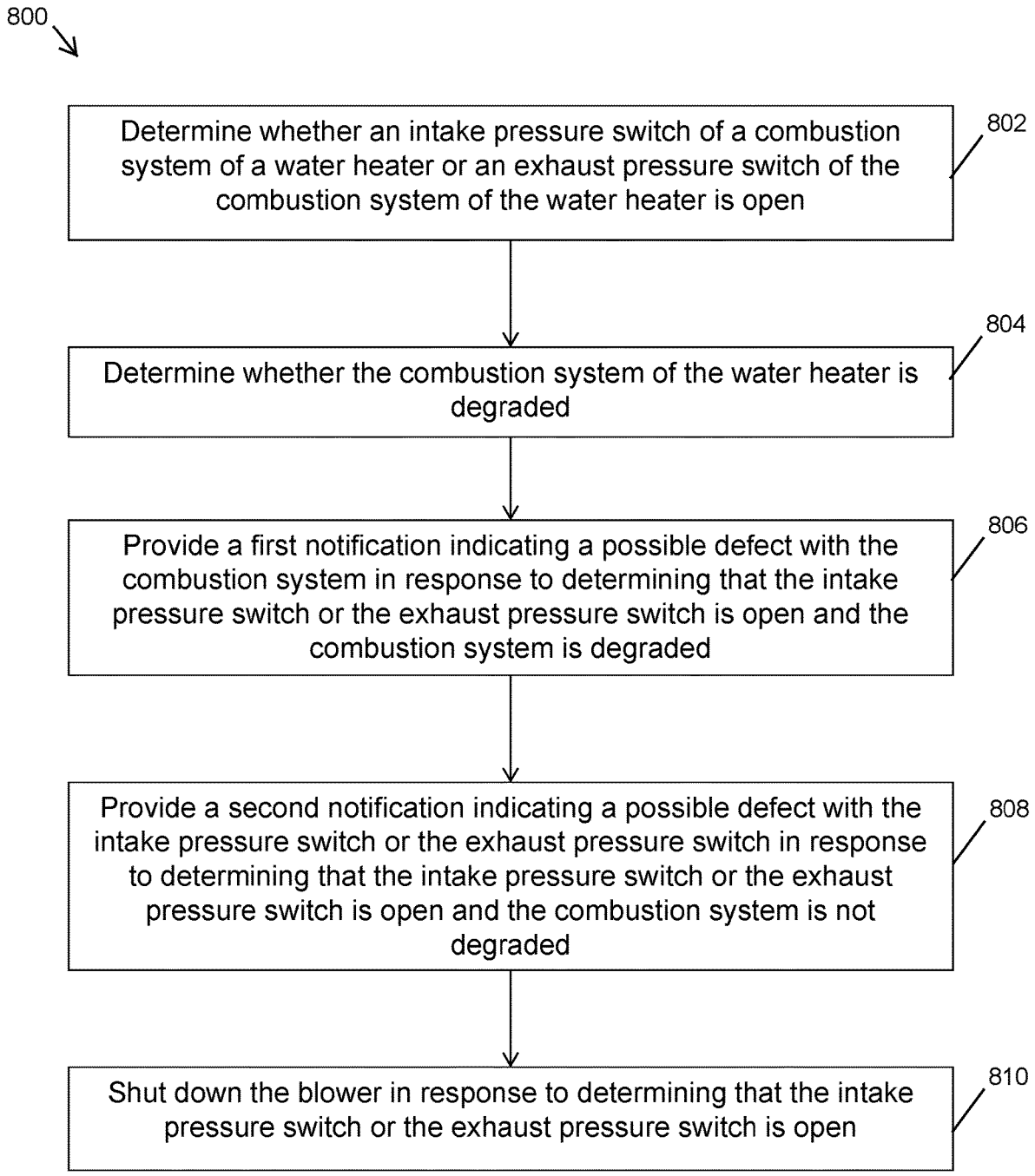
FIG. 8 illustrates a method of monitoring and notification of water heater system conditions according to another example embodiment.

FIG. 8 illustrates a method 800 of monitoring and notification of water heater system conditions according to another example embodiment. Referring to FIGS. 1-3 and 8, in general, the method 800 determines whether an intake or exhaust pressure switch may be defective. To illustrate, the intake and exhaust pressure switches are closed under normal operations. The intake and/or exhaust pressure switches become opened if exhaust pressure or inlet vacuum is too high, for example, because of blocked vent piping. The resulting unloading effect on the blower should normally be accompanied by a decrease in the pulse width of the PWM signal.

In some example embodiments, the method 800 includes, at step 802, determining whether an intake pressure switch of a combustion system of a water heater or an exhaust pressure switch of the combustion system of the water heater is open. For example, the controller 102 or the central control circuit 202 may receive one or more electrical signals from the intake pressure switch and/or the exhaust pressure switch and determine whether switches are open.

At step 804, the method 800 may include determining whether a combustion system of the water heater is degraded, for example, as described with respect to FIG. 7. At step 806, the method 800 may include providing a first notification indicating a possible defect with the combustion system in response to determining that the intake pressure switch or the exhaust pressure switch is open and the combustion system is degraded. At step 808, the method 800 may include providing a second notification indicating a possible defect with the intake pressure switch or the exhaust pressure switch in response to determining that the intake pressure switch or the exhaust pressure switch is open and the combustion system is not degraded. At step 810, the method 800 may include shutting down the blower of the combustion system in response to determining that the intake pressure switch or the exhaust pressure switch is open. In some example embodiments, the method 800 may also include locking down the combustion system or the water heater system after shutting down the blower.

In some example embodiments, the controller 102, the display control circuit 204, or another component of the water heater systems 100, 200 may provide the notifications to a user, owner, etc. via a display of the particular water heater system (e.g., the display device 110, the user interface 316, or another display device). For example, the color of the display (e.g., an icon or an area of the display) may be changed to a color associated with a particular notification. The notifications may alternatively or in addition be transmitted wirelessly or via a wired connection to a BMS, a mobile device that may include a relevant software application, to a local or cloud server, etc. In some example embodiments, the notifications may be audio notification instead of or in addition to visual and/or transmitted notifications.

In some example embodiments, the microcontroller 308 of FIG. 3 and/or another microcontroller may execute software code stored in the memory device 310 and/or in another memory device of the water heater system 100, 200, and/or retrieved from a local or cloud server (e.g., the server 116) to perform the steps of the method 800. The microcontroller 308 of FIG. 3 and/or another microcontroller may also use and store data from/to the memory device 310 and/or in another memory device of the water heater system 100, 200, and/or retrieve/store from/to a local or cloud server (e.g., the server 116) in performing the steps of the method 800.

In some example embodiments, one or more steps of the method 800 may be omitted without departing from the scope of this disclosure. In some example embodiments, the method 800 may include additional steps than described above or shown in FIG. 8 without departing from the scope of this disclosure. In some example embodiments, some steps of the method 800 may be performed in a different order than described above without departing from the scope of this disclosure.

Figure 9:
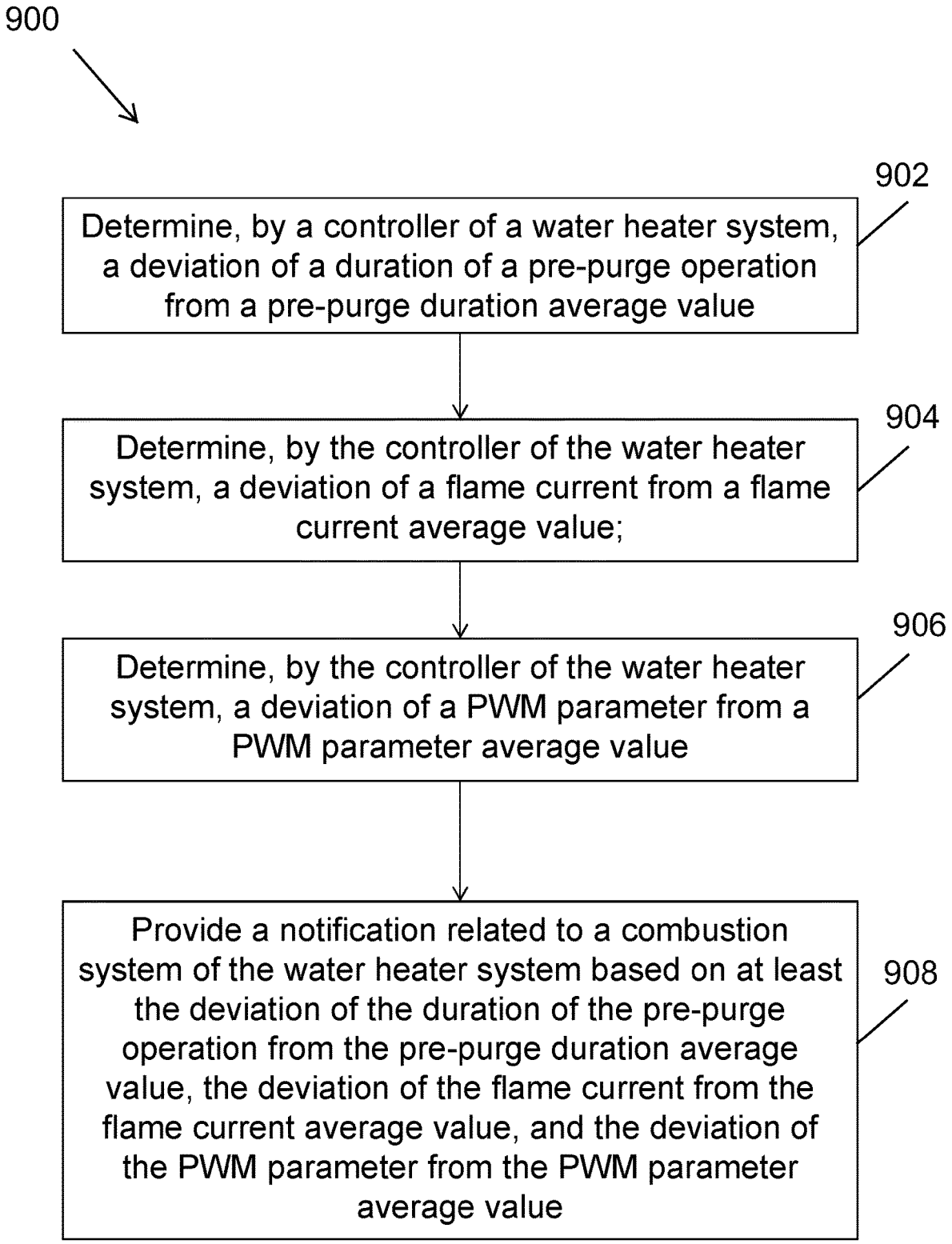
FIG. 9 illustrates a method of monitoring and notification of water heater system conditions according to another example embodiment.

FIG. 9 illustrates a method 900 of monitoring and notification of water heater system conditions according to another example embodiment. Referring to FIGS. 1-4, 6, 7, and 9, in some example embodiments, the method 900 includes, at step 902, determining, by a controller of a water heater system 100, 200, a deviation of a duration of a pre-purge operation from a pre-purge duration average value. For example, the controller 102 or the central control circuit 202 may determine the deviation of the duration of the pre-purge operation from the pre-purge duration average value. For example, the controller 102 or the central control circuit 202 may determine the deviation as described above with respect to FIG. 4 and the method 400.

At step 904, the method 900 may include determining, by the controller of the water heater system 100, 200, a deviation of a flame current from a flame current average value. For example, the controller 102 or the central control circuit 202 may determine the deviation of the flame current from the flame current average value. For example, the controller 102 or the central control circuit 202 may determine the deviation as described above with respect to FIG. 6 and the method 600.

At step 906, the method 900 may include determining, by the controller of the water heater system 100, 200, a deviation of a PWM parameter from a PWM parameter average value. For example, the controller 102 or the central control circuit 202 may determine the deviation of the PWM parameter from a PWM parameter average value. For example, the controller 102 or the central control circuit 202 may determine the deviation as described above with respect to FIG. 7 and the method 700.

At step 908, the method 900 may include providing a notification related to a combustion system of the water heater system 100, 200 based on at least the deviation of the duration of the pre-purge operation from the pre-purge duration average value, the deviation of the flame current from the flame current average value, and the deviation of the PWM parameter from the PWM parameter average value.

In some example embodiments, the method 900 may include determining, by the controller of the water heater system 100, 200, a ratio of a number successful ignition cycles of the combustion system to a number of total ignition cycles. For example, the controller 102 or the central control circuit 202 may determine the ratio of the number successful ignition cycles of the combustion system to the number of total ignition cycles. For example, the number of total ignition cycles may be the sum of successful ignition cycles and failed ignition cycles (i.e., ignition failed). In some example embodiments, the provided notification may also be based on the ratio of the number successful ignition cycles of the combustion system to the number of total ignition cycles. For example, a combustion system condition may be calculated using Equation 1 shown below:

$$C_health = 300 + che_svfi - che_pscd - che_fcdv - che_bpdv \quad \text{Eq. 1}$$

where,

C_health=combustion system condition;

che_svfi=the ratio of the number successful ignition cycles of the combustion system to the number of total ignition cycles che_pscd=the deviation of the duration of the pre-purge operation from the pre-purge duration average value;

che_fcdv=the deviation of the flame current from the flame current average value; and che_bpdv=the deviation of the PWM parameter from a PWM parameter average value.

In Equation 1, the value, 300, is used for convenience to keep the combustion system condition non-negative and may otherwise be omitted or replaced by another value.

In some example embodiments, the method 900 may include calculating the combustion system condition, C_health, as shown in Equation 1 or in a similar manner and comparing the calculated value of the combustion system condition against one or more thresholds to determine the condition of the combustion system. One or more visual, audio and/or transmitted notifications may be provided based on the comparison against the one or more thresholds in a similar manner as described above.

To illustrate, considering the combustion system condition as a percentage value (for example, for Equation 1, a percentage with respect to 400), the combustion system condition, C_health, may indicate that the combustion system of the water heater system 100, 200 is in a good working condition when the combustion system condition, C_health, above a first threshold (e.g., 79%). In some example embodiments, the combustion system condition, C_health, may indicate that the combustion system of the water heater system 100, 200 is in a sub-optimal working condition when the combustion system condition, C_health, greater than a second threshold (e.g., 55.5%) and less than the first threshold. In some example embodiments, the combustion system condition, C_health, may indicate that the combustion system of the water heater system 100, 200 is needs to be serviced when the combustion system condition, C_health, greater than the second threshold. For each of the above determinations, a respective visual, audio, and/or transmitted notification may be provided.

In some example embodiments, the controller 102, the display control circuit 204, or another component of the water heater systems 100, 200 may provide the notifications to a user, owner, etc. via a display of the particular water heater system (e.g., the display device 110, the user interface 316, or another display device). For example, the color of the display (e.g., an icon or an area of the display) may be changed to a color associated with a particular notification. The notifications may alternatively or in addition be transmitted wirelessly or via a wired connection to a BMS, a mobile device that may include a relevant software application, to a local or cloud server, etc. In some example embodiments, the notifications may be audio notification instead of or in addition to visual and/or transmitted notifications.

In some example embodiments, the microcontroller 308 of FIG. 3 and/or another microcontroller may execute software code stored in the memory device 310 and/or in another memory device of the water heater system 100, 200, and/or retrieved from a local or cloud server (e.g., the server 116) to perform the steps of the method 900. The microcontroller 308 of FIG. 3 and/or another microcontroller may also use and store data from/to the memory device 310 and/or in another memory device of the water heater system 100, 200, and/or retrieve/store from/to a local or cloud server (e.g., the server 116) in performing the steps of the method 900.

In some example embodiments, one or more steps of the method 900 may be omitted without departing from the scope of this disclosure. In some example embodiments, the method 900 may include additional steps than described above or shown in FIG. 9 without departing from the scope of this disclosure. In some example embodiments, some steps of the method 900 may be performed in a different order than described above without departing from the scope of this disclosure.

Although example embodiments are described herein, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A water heater monitoring and notification method, comprising:

determining a minimum flame current from among multiple flame currents;

determining a maximum flame current from among the multiple flame currents; and determining whether a subsequent flame current generated at approximately the maximum gas input rate meets an operational requirement, wherein the subsequent flame current meets the operational requirement if the subsequent flame current is more than the minimum flame current, less than the maximum flame current, and more than a threshold flame current.

2. The method of claim 1, further comprising receiving the multiple flame currents, wherein the multiple flame currents are generated at approximately a maximum gas input rate and wherein the multiple flame currents are produced during multiple ignition cycles.

3. The method of claim 1, further comprising providing a notification in response to determining the subsequent flame current fails to meet the operational requirement and if a combustion system of a water heater system is degraded.

4. The method of claim 3, further comprising determining whether the combustion system of the water heater system is degraded based on a speed of a blower of the water heater system and a pulse width of a pulse width modulation signal that is used to adjust the speed of the blower.

5. The method of claim 1, further comprising providing a notification indicating the flame sensor is degraded in response to determining that a threshold number of subsequent flame currents generated at approximately the maximum gas input rate during the threshold number of ignition/heating cycles each fails to meet the operational requirement.

6. A system for water heater monitoring and notification, comprising:

a controller configured to:

determine a minimum flame current from among multiple flame currents;

determine a maximum flame current from among the multiple flame currents; and determine whether a subsequent flame current generated at approximately the maximum gas input rate meets an operational requirement, wherein the subsequent flame current meets the operational requirement if the subsequent flame current is more than the minimum flame current, less than the maximum flame current, and more than a threshold flame current.

7. The system of claim 6, wherein the controller is further configured to receive the multiple flame currents, wherein the multiple flame currents are generated at approximately a maximum gas input rate, and wherein the multiple flame currents are produced during multiple ignition cycles.

8. The system of claim 6, wherein the controller is further configured to provide a notification in response to determining the subsequent flame current fails to meet the operational requirement and if a combustion system of a water heater system is degraded.

9. The system of claim 8, wherein the controller is further configured to determine whether the combustion system of the water heater system is degraded based on a speed of a blower of the water heater system and a pulse width of a pulse width modulation signal that is used to adjust the speed of the blower.

10. The system of claim 6, wherein the controller is further configured to provide a notification indicating the flame sensor is degraded in response to determining that a threshold number of subsequent flame currents generated at approximately the maximum gas input rate during the threshold number of ignition/heating cycles each fails to meet the operational requirement.

* * * * *